United States Patent [19]

Thomson

[11] Patent Number: 4,775,201

[45] Date of Patent: Oct. 4, 1988

[54] REMOVABLE TILT-DOWN BIN FOR REFRIGERATOR

[75] Inventor: Eugene F. Thomson, Center Township, Vanderburgh County, Ind.

[73] Assignee: Whirlpool Corporation, Benton Harbor, Mich.

[21] Appl. No.: 931,582

[22] Filed: Nov. 14, 1986

[51] Int. Cl.[4] ..... A47B 67/02

[52] U.S. Cl. ..... 312/248; 312/251

[58] Field of Search ..... 312/248, 251, 245, 214

[56] References Cited

U.S. PATENT DOCUMENTS

| | | | |
|---|---|---|---|
| 782,430 | 2/1905 | Tone . | |
| 1,055,519 | 3/1913 | Conser . | |
| 1,356,620 | 10/1920 | Grubb . | |
| 1,485,496 | 3/1924 | Elliott . | |
| 2,074,785 | 3/1937 | Gentz . | |
| 2,812,097 | 11/1957 | Legge | 312/248 X |
| 2,882,113 | 4/1959 | Gantner | 312/248 |
| 2,898,173 | 8/1959 | Squire | 312/248 |
| 3,638,717 | 2/1972 | Harbour et al. . | |
| 3,846,005 | 11/1974 | Harper et al. | 312/248 |
| 4,186,978 | 2/1980 | Thomson . | |
| 4,528,825 | 7/1985 | Khan . | |

*Primary Examiner*—Joseph Falk

*Attorney, Agent, or Firm*—Lowe, Price, Leblanc, Becker & Shur

[57] ABSTRACT

A food bin is hinged to a pair of vertical supports beneath a shelf of a refrigerator to enable the bin to pivot open for access. The hinges of the bin disengage when the bin is pivoted open beyond a predetermined angle to enable the bin to be removed from the refrigerator for cleaning. A pair of cords connected between the bin and supports limits the extent to which the bin can be pivoted open, maintaining the hinges coupled together. The cords are somewhat resilient to absorb shock when the bin bottoms as it is pivoted fully open and are releasable from the supports to enable the bin to be pivoted beyond the predetermined angle for removal.

3 Claims, 4 Drawing Sheets

REMOVABLE TILT-DOWN BIN FOR REFRIGERATOR

TECHNICAL FIELD

This invention relates generally to a removable food bin for a refrigerator and, more particularly, to a tiltable food containment bin that is easily removable from the refrigerator for cleaning.

BACKGROUND OF THE INVENTION

Modern refrigerators are designed to provide considerable latitude in how different kinds of foods are stored separately. Thus it is common to find in such refrigerators provisions for mounting a variety in shelves, bins and racks of different positions to separately support or contain assorted foods.

Certain types of foods, e.g., fruits and vegetables, are best contained in bin-like compartments rather than on flat shelves or racks. It is desirable to have the bins covered to reduce the drying out of their contents due to cold dry air circulation in the refrigerator. One solution is to locate the bins directly beneath shelves that provide convenient support for other items such as milk cartons, fruit juice containers and the like. The practical problem then becomes one of providing the user easy access to what is in the bin beneath the shelf while permitting the shelf to serve effectively as a lid over the contents of the bin when access is not desired.

Preferably, the rear of the bin is pivotally mounted to a support system in the refrigerator to enable the front of the bin to be lowered easily even under a heavy food load for convenient access by the user. When not so lowered, the bin should be capable of being positioned to most efficiently store its contents. Naturally, the bin should be easily removable by a user who wishes to clean it, and this process should not require the user to empty out a substantial portion of the rest of the refrigerator.

Movable storage compartments for refrigerators which tilt for access or are movable for cleaning exist, but none conveniently pivot open for access and release from the refrigerator for cleaning.

For example, in U.S. Pat. No. 4,186,978 to Thomson portions of an inner surface of a refrigerator door provide support and guidance to a lid-covered receptacle that pivots out with simultaneous movement of the lid to allow access to the receptacle contents.

In U.S. Pat. No. 4,528,825 to Kahn, a lower foldable refrigerator shelf is nested directly beneath an upper shelf in a locked position and can be moved to a plurality of positions spaced from the upper shelf by means of sliding and pivoting links. There is a provision for locking the lower shelf positively when the shelf is in a folded position and continuously biasing it into a stable position when unfolded.

U.S. Pat. No. 3,638,717 to Harbour et al discloses insulated partitions for placement in the freezer section of a refrigerator. The partitions are movable to different positions to change the air flow path so that a meat-keeper compartment space is converted to supplemental freezing space.

Similarly, U.S. Pat. No. 2,074,785 to Gentz discloses a rack adapted to be secured to the inside wall of a refrigerator door to provide easily accessed additional shelf space for the storage of food.

None of these containers is both conveniently located below a horizontal shelf and removable for cleaning.

There accordingly remains a need for a food storage bin-like container that can be selectively mounted within a refrigerator, tilts to permit easy access to its contents, and is easily removable. The bin further should withstand sudden loads in case it is lowered abruptly, and should store its contents conveniently directly beneath a shelf.

DISCLOSURE OF THE INVENTION

Accordingly, it is an object of this invention to provide in a refrigerator an improved food storage bin that pivots open to alloy easy access to its contents.

It is also an object of this invention to provide in a refrigerator a food storage bin that is tiltable for easy access to its contents and is readily removed from the refrigerator for cleaning.

A related further object is to provide in a refrigerator a food storage bin that is pivotally supported at its rear for access, may be latched closed and absorbs shock if it is opened abruptly when loaded.

It is yet another object of this invention to provide in a refrigerator a removable food storage bin which is pivotally supported at its rear, is tiltable to permit easy access to its contents, and can be latched closed directly beneath a shelf.

These and other objects of this invention are realized by providing, in a refrigerator having a cabinet defining a stationary support surface, a system for supporting a removable food containment bin having a movable surface, comprising a first hinge means on the stationary surface, a second hinge means on the movable surface and interference means for preventing the first and second hinge means, once engaged together, from becoming disengaged when the bin is opened within a predetermined angle of rotation. A rotation limiting means limits the angular rotation of the bin to remain within the predetermined angle of rotation to retain the hinge means engaged. The limiting means is releasable to enable the hinge means to disengage so that the bin can be removed from the refrigerator.

Preferably, the first and second hinge means comprise a pin and collar arrangement with one portion of the periphery of the collar open to enable the pin to be removed therethrough by the user when releasing the bin from the refrigerator for cleaning. The interface means preferably comprises a pair of tabs extending respectively from the stationary surface and bin. The tabs are positioned such that they contact each other to retain the pin and collar engaged when the orientation of the bin is within the predetermined angle of rotation.

The rotation limiting means preferably comprises a pair of cords connected between the support surface and the bin and having a length great enough to enable the bin to pivot to a position for convenient access thereto, but small enough to maintain the hinge means engaged. Some resiliency in the cords absorbs shock of the bin when the bin, if heavily loaded with food, is abruptly opened. One end of each cord is releasable to enable the hinge means to be disengaged for removal of the bin from the refrigerator.

Still other objects and advantages of the present invention will become readily apparent to those skilled in the art from the following detailed description, wherein only the preferred embodiment of the invention is shown, simply by way of illustration of the best mode contemplated for carrying out the invention. As will be realized, this invention is capable of other and different embodiments, and its several details are capable of modification in various obvious respects, all without departing from the invention. Accordingly, the drawing and description herein are to be regarded as merely illustrative in nature, and not as restrictive.

DESCRIPTION OF THE PREFERRED EMBODIMENT

Figure 1:
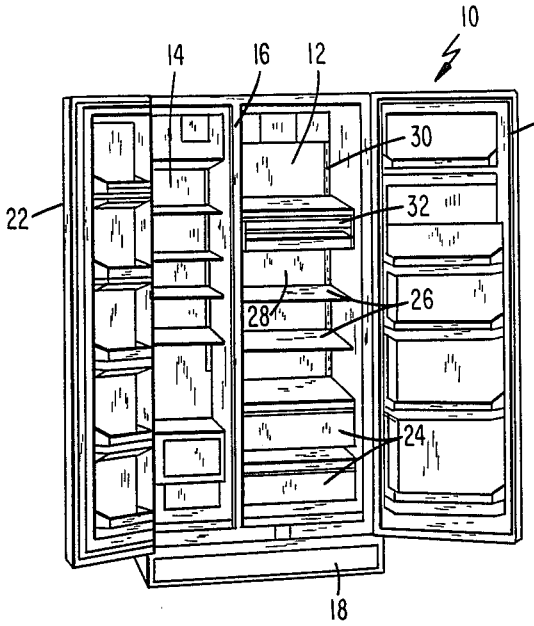
FIG. 1 is a perspective view of a typical refrigerator, with its doors open to expose various shelves and food containment compartments therein.

A conventional refrigerator 10, shown in FIG. 1, commonly referred to as a side-by-side unit, has a refrigeration compartment 12 and a freezer compartment 14 separated from each other by a divider wall 16. Conventionally, the interior of refrigerator 10 is cooled by an evaporator (not shown) located in the freezer compartment and a compressor and a condenser (not shown) located in machinery compartment 18. The refrigerator has frontal doors 20, 22 providing access to the interior of the refrigeration and freezer compartments, respectively. The refrigeration compartment 12 is provided with a number of drawers 24 for storing food and also a plurality of vertically adjustable shelves 26 each supported to rear wall 28 of the refrigeration compartment by brackets or hangers (not shown) hooked to a pair of support ladders 30 (only one shown), in a conventional manner.

Figure 2:
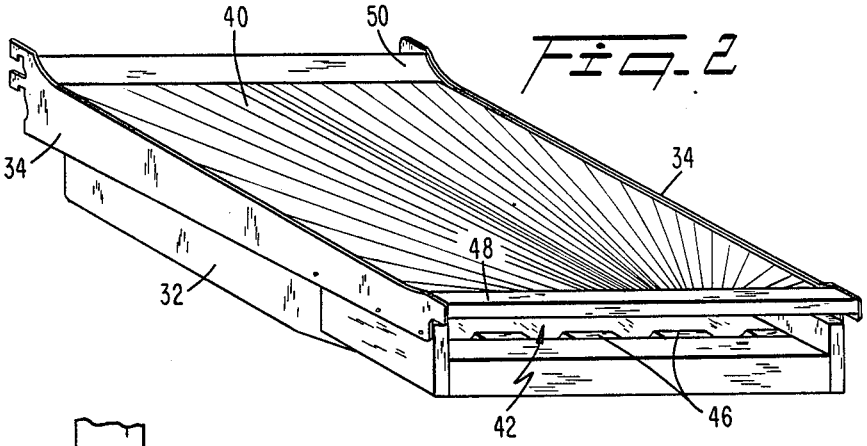
FIG. 2 is a perspective view of a preferred embodiment of the invention, with the food storage bin latched closed.
Figure 3A:
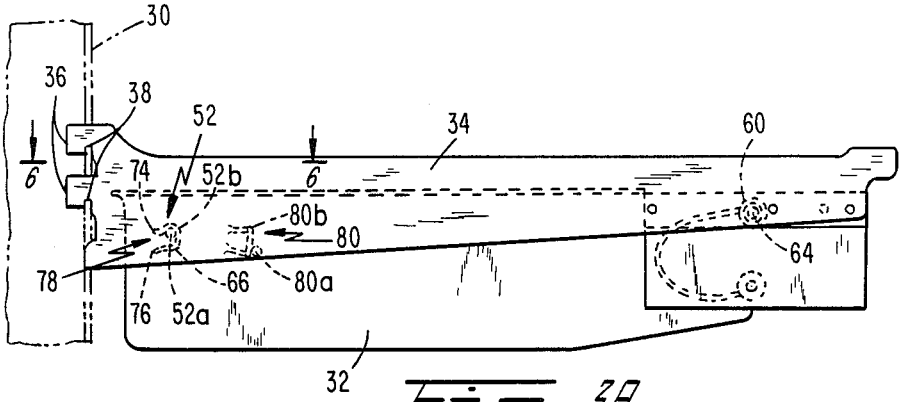
FIG. 3A is a side elevation view of the invention, with the food storage bin closed.
Figure 3B:
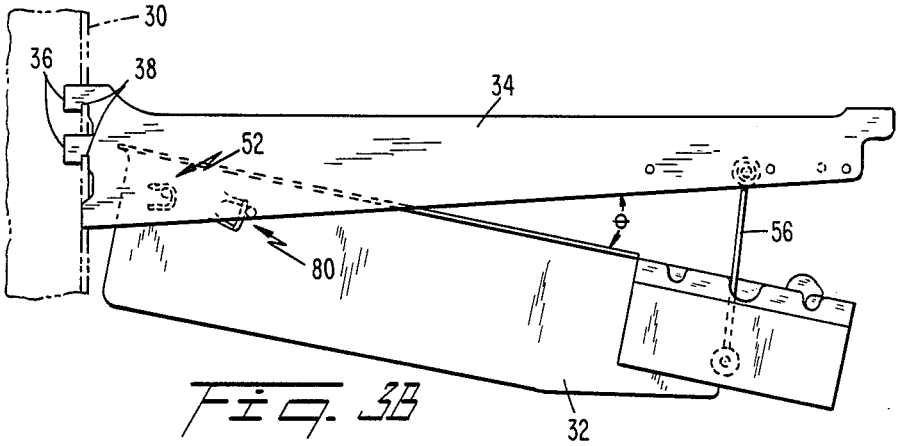
FIG. 3B is a side elevation view of the invention, with the bin pivoted open.
Figure 3C:
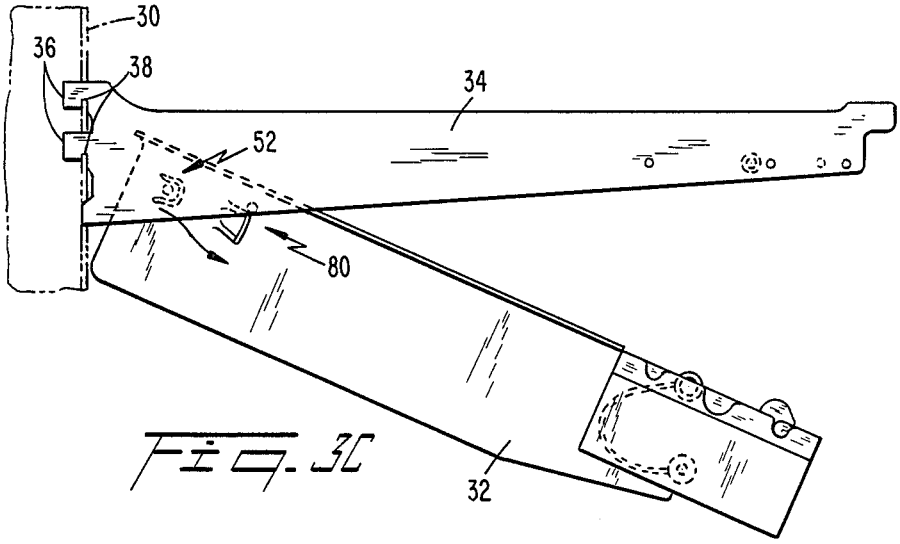
FIG. 3C is a side elevation view of the invention, with the bin further pivoted for removal.
Figure 4:
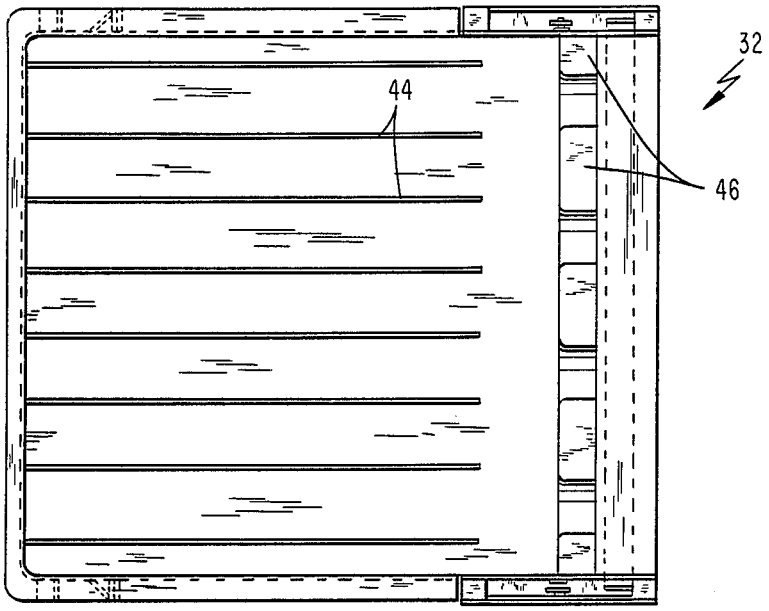
FIG. 4 is a top plan view of a bin in accordance with the invention.
Figure 5:
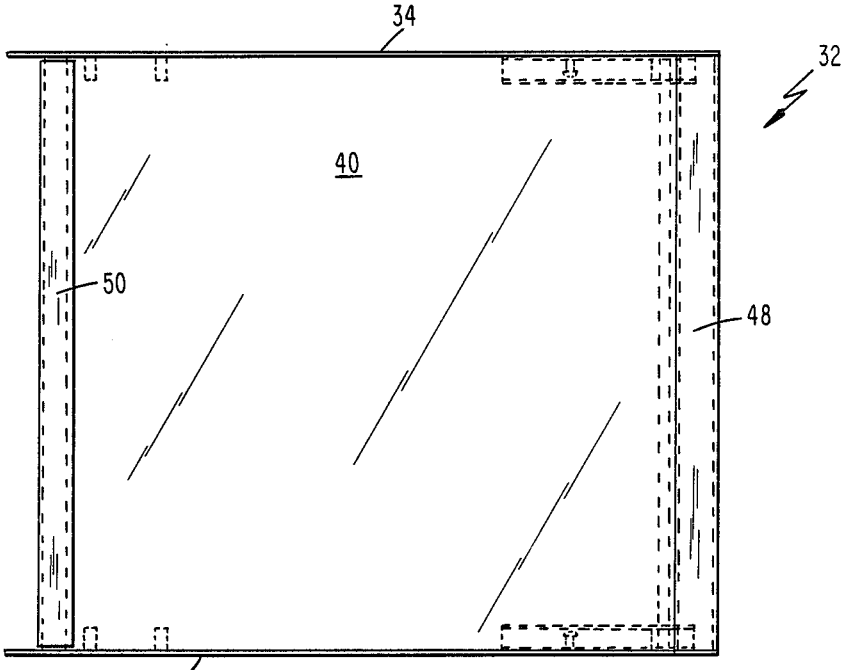
FIG. 5 is a plan view of the shelf located directly above the bin in accordance with one aspect of this invention.

A food storage bin 32 is mounted by brackets 34 to the ladders 30, as best shown in FIGS. 3A–3C, with hooks 36 of the brackets retained within corresponding apertures 38 of the ladders. A shelf 40 (FIGS. 2 and 5) supported close to the upper horizontal edges of brackets 34 is positioned directly above the bin 32, and a small opening 42 is thereby established between the shelf and bin. The bin 32, when closed as shown in FIG. 2, is substantially parallel to brackets 34 and shelf 40. Bin 32, which preferably is rectangular in plan view, may be provided with small ribs 44 and lands 46 convenient for storage of wine bottles, viewable by the user through the opening 42. The shelf 40 is retained to brackets 34 at front and rear strips 48 and 50, shown in FIG. 5, in a conventional manner.

Figure 6:
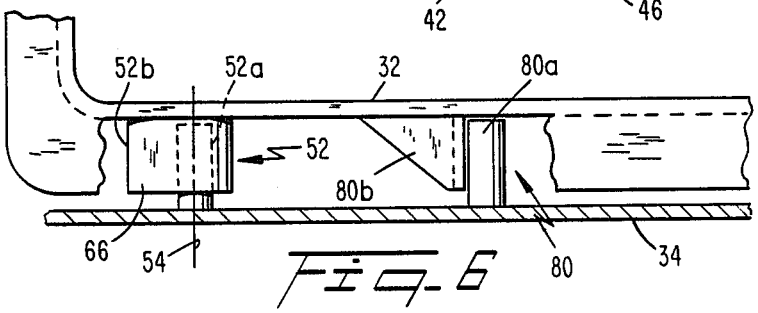
FIG. 6 is an enlarged partial plan view of a rear corner of the invention with a portion broken away to expose the hinge and interference means.

The bin 32 is hinged at 52 to pivot between a closed position, shown in FIG. 3A, and an open position (FIG. 3B). Each hinge 52 comprises a pin **52*a* extending from support bracket 34 and an arcuate collar 52*b* extending from one side of bin 32 as best shown in FIG. 6. Pin 52*a* and collar 52*b* at each side of the bin 32 are aligned on a common axis 54**.

With the pin **52*a* journaled in collar 52*b*, the bin 32 is free to pivot about the rear portion of the support brackets 34. The extent to which the bin 32 is permitted to pivot open, however, is limited by the length of a pair of cords 56, shown in FIG. 3B, connected between the bin 32 and support brackets 34. Each cord 56 is formed of a slightly resilient material, such as a plastic monofilament, to absorb shock if the bin, when heavily loaded with food, "bottoms-out" as it is opened abruptly. As shown in FIG. 8, eyelets 58 and 60 at the ends of each cord 56 (FIG. 8), are pressed respectively onto pins 62 on opposite sides of bin 32 (FIG. 7) and pins 64 on support brackets 34. When the bin is closed, as shown in FIG. 3A, each cord 56 is retained within a housing 67 formed at each side of the bin 32, as shown in FIG. 8**.

Referring to FIG. 3A, collar **52*b* of hinge 52 has an arcuate portion 66 with radially extending ends 74 and 76 defining an opening 78. The opening 78 of the collar 52*b* establishes a path for egress of pin 52*a* when the hinge 52 is disengaged for removal of the bin 32 from the refrigerator 10. The hinge 52 thus is releasable; it pivots the bin 32 about support brackets 34** as shown in FIGS. 3A and 3B, but enables the bin to be detached from the support brackets and removed from the refrigerator for cleaning (FIG. 3C).

To prevent the bin 32 from being inadvertently detached from support brackets 34, an interference means 80 at each side of bin 32 comprises a pin **80*a* (FIG. 6) extending inward from the bracket and a corresponding ear 80*b* extending outward from the bin. The pin 80*a* and ear 80*b* of the interference means 80 are displaced from each other so as to overlap, as shown in FIG. 6, to retain pin 52*a* within the arcuate shoulder 52*b* of hinge 52**.

With reference to FIGS. 3A and 3B, each ear **80*b* has a lateral extent sufficient to interfere with pin 80*a* as the bin is pivoted throughout a predetermined angle $\theta$ between its closed and open bin positions, shown respectively in FIGS. 3A and 3B. Only by further opening the bin beyond angle $\theta$ until the pin 80*a* and ear 80*b* no longer interfere with each other can the hinge 52 be disengaged by sliding the bin forward and down, as shown by the arrow in FIG. 3C, so that the collar 52*b* slips off pin 52*a* of each hinge 52. Of course, this requires that the cords 56 between supports 34 and bin 32 first be disconnected by removing eyelets 60 from pins 64**.

Figure 7:
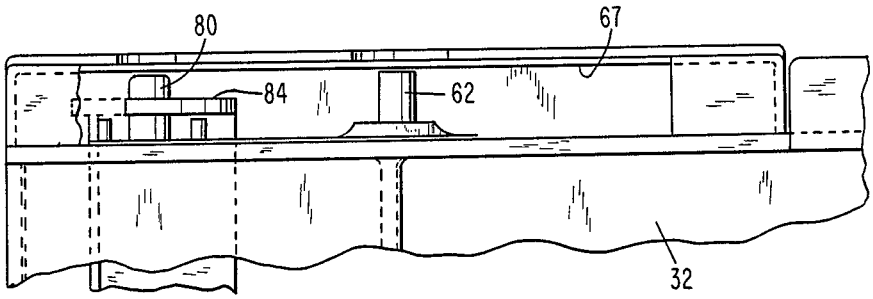
FIG. 7 is a partial plan view of a front corner of the invention with a portion broken away to expose a part of the latch means and cord retaining pin.
Figure 8:
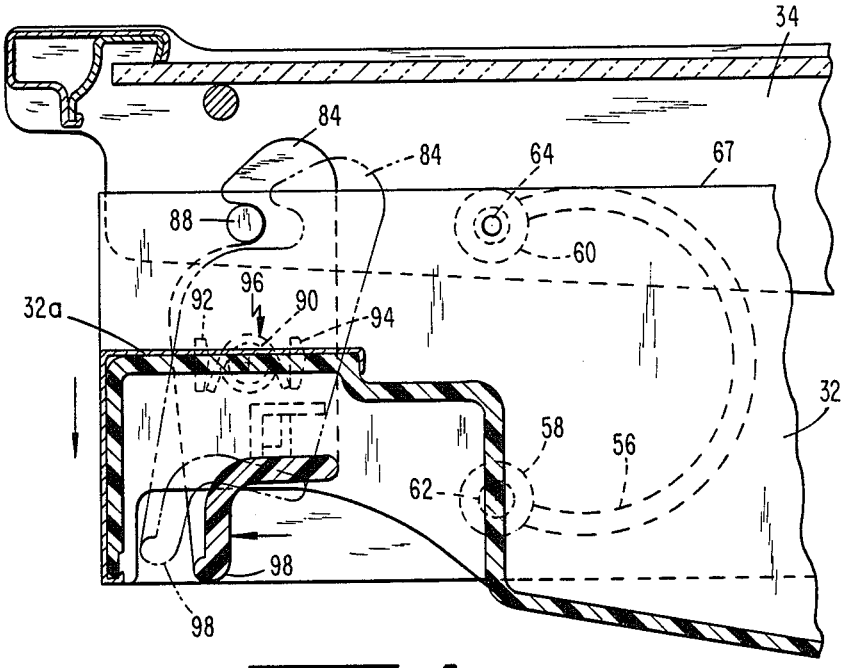
FIG. 8 is a partial sectional elevation view of a preferred embodiment of this invention, with the latch mechanism in its engaged (solid lines) and disengaged (dotted lines) states, respectively.

The bin 32 is latched closed in FIG. 3A by a latch mechanism 82, shown in FIGS. 7 and 8. Within an enclosed portion **32*a* of bin 32 at the front of each side of the bin, a latch hook 84 is resiliently biased by a spring 96 into engagement with a pin 88 extending from a corresponding support bracket 34. The latch hook 84 pivots about a pivot member 90 provided at the front of the bin. Pivot member 90 preferably is integrally molded with housing 67. Spring 96 is located by pivot 90 and contacts a first extension 92 on either the hook 84 or the bin 32 and a second extension 94 on the other of the hook or bin to bias the hook into engagement with pin 88. A user-graspable handle 98 at the lower end of the hook 84 enables the user to manually disengage the hook from pin 88** and thereby release the bin for opening.

Thus, when the user wishes to open bin 32, he or she applies a force (see arrow) to handle 98 toward the front of the bin. At that point, the user must be supporting the front of the bin 32. As the bin pivots open, the cords 56 straighten until the bin is fully open, as shown in FIG. 3B. Only by releasing the two cords 56 from the brackets 34 can the bin 32 be released from its hinges 52 and removed from the refrigerator 10.

There accordingly has been described a food storage bin 32 that pivots open on support brackets 34 to enable the user to have convenient access to the contents of the bin. Releasable hinges 52 supporting the bin on the brackets enable the bin to be removed from the refrigerator for cleaning. The hinges 52 are configured to disengage when the bin is moved forward, but such movement is blocked by an interference means 80 on the bin and support brackets when the angle of rotation of the bin is less than a predetermined angle. Slightly resilient cords 56 prevent the bin from being pivoted open beyond the predetermined angle to maintain the hinges engaged during normal operation of the bin. To remove the bin for cleaning, the cords 56 are released, the bin is further pivoted open beyond the predetermined angle to disengage the hinges 52 and the bin is pulled from the support brackets, out of the refrigerator.

In this disclosure, there is shown and described only the preferred embodiment of the invention, but, as aforementioned, it is to be understood that the invention is capable of use in various other combinations and environments and is capable of changes or modifications within the scope of the inventive concept as expressed herein.

What is claimed is:

1. In a refrigerator having a cabinet defining a compartment and a stationary surface in said compartment, a system for supporting a removable surface, comprising:

a movable surface;

a first hinge means on said stationary surface;

a second hinge means on said movable surface removably engagable with said first hinge means;

interference means for preventing said first and second hinge means, once engaged with each other, from becoming disengaged within a predetermined angle of rotation of said movable surface with respect to said stationary surface about an axis defined by said first and second hinge means; and releasable angular rotation limiting means for limiting the angle of rotation of said movable surface with respect to said stationary surface about said axis to be within said predetermined angle of rotation, wherein said first hinge means comprises a pin perpendicular to said stationary surface and said second hinge means comprises an arcuate bearing for retaining said pin, said bearing having an open region for removal radially therethrough of said pin, said interference means comprises first and second interference members positioned respectively on said movable and stationary surfaces at slightly different distances from said axis and extending in opposite directions such that said first and second interference members overlap when said stationary and movable surfaces are oriented relative to each other within said predetermined angle of rotation, and said angular rotation limiting means comprises a cord connected between said stationary and movable surfaces, said cord having a length small enough to prevent an angle of rotation between said stationary and movable surfaces from exceeding said predetermined angle of rotation.

2. The system of claim 1, wherein said cord is connected between said stationary and moveable surfaces at an end of said surfaces opposite said hinge means.

3. The system of claim 1, wherein said cord is slightly resilient.

* * * * *